United States Patent [19]

White et al.

[11] Patent Number: 5,022,882

[45] Date of Patent: Jun. 11, 1991

[54] ARC TUBE DOSING PROCESS FOR UNSATURATED HIGH PRESSURE SODIUM LAMP

[75] Inventors: Philip J. White, Georgetown; Dennis B. Shinn, Topsfield, both of Mass.

[73] Assignee: GTE Products Corporation, Danvers, Mass.

[21] Appl. No.: 617,439

[22] Filed: Nov. 19, 1990

Related U.S. Application Data

[63] Continuation of Ser. No. 277,467, Nov. 23, 1988, abandoned, which is a continuation of Ser. No. 473,892, Mar. 10, 1983, abandoned.

[51] Int. Cl.[5] ..... H01J 9/00

[52] U.S. Cl. ..... 445/21; 445/26

[58] Field of Search ..... 445/17, 21, 26, 31, 445/41, 53

[56] References Cited

U.S. PATENT DOCUMENTS

| | | | |
|---|---|---|---|
| 2,249,672 | 7/1941 | Spanner | 445/17 |
| 3,279,877 | 10/1966 | Smith | 445/26 |
| 3,385,645 | 5/1968 | Smith | 445/21 |
| 3,657,589 | 4/1972 | Della Porta et al. | 445/31 |
| 4,156,550 | 5/1979 | Furukubo et al. | 445/53 |
| 4,157,485 | 6/1979 | Wesselink et al. | 445/26 |
| 4,333,032 | 6/1982 | Wyner et al. | 445/41 |

FOREIGN PATENT DOCUMENTS

| | | | |
|---|---|---|---|
| 0128172 | 11/1978 | Japan | 427/124 |
| 0133732 | 10/1980 | Japan | 445/41 |
| 0143771 | 11/1980 | Japan | 427/124 |
| 1211175 | 11/1970 | United Kingdom . | |
| 1211176 | 11/1970 | United Kingdom . | |

*Primary Examiner*—Kurt Rowan

*Attorney, Agent, or Firm*—Thomas H. Buffton; Martha Ann Finnegan

[57] ABSTRACT

A process of dosing the arc tube of an unsaturated vapor high pressure sodium lamp wherein a sodium-containing compound, an oxygen-absorbing getter, mercury and a rare gas are deposited within the arc tube, and the arc tube is sealed whereby thermal decomposition of the sodium-containing compound is effected within the arc tube and the getter prevents compound reformation by absorbing the oxygen therein.

6 Claims, 3 Drawing Sheets

ARC TUBE DOSING PROCESS FOR UNSATURATED HIGH PRESSURE SODIUM LAMP

This is a continuation of copending application Ser. No. 07/277,467, filed on Nov. 23, 1988, now abandoned, which is a continuation of parent case Ser. No. 06/473,892, filed on Mar. 10, 1983, now abandoned.

CROSS REFERENCE TO OTHER APPLICATIONS

Concurrently filed applications entitled "Unsaturated Vapor Pressure Type High Pressure Sodium Lamps," U.S. Ser. No. 473,895, and "Unsaturated Vapor High Pressure Sodium Lamp Getter Mounting," U.S. Ser. No. 473,897, relate to an arc tube and an arc tube fabricating process for unsaturated vapor high pressure sodium lamps. Also, concurrently filed applications entitled "Unsaturated Vapor High Pressure Sodium Lamp Arc Tube Fabrication Process," U.S. Ser. No. 473,894, and "Arc Tube Fabrication Process," U.S. Ser. No. 473,896, relate to arc tube fabrication of unsaturated vapor high pressure sodium lamps.

TECHNICAL FIELD

This invention relates to unsaturated vapor high pressure sodium lamps and more particularly to a process for dosing an arc tube for an unsaturated vapor high pressure sodium lamp.

BACKGROUND ART

In the field of high pressure sodium lamps, it is a common practice to provide an arc tube fill which includes a large amount of sodium and mercury in order to compensate for the undesired sodium losses encountered. These excess amounts of sodium and mercury result in an amalgam at the coolest points of the arc tube which is normally adjacent the electrodes at the ends of the arc tube. As a result, undesired variations in source voltage, color rendition and numerous other characteristics are encountered.

In an effort to eliminate or at least reduce such undesired effects, it has long been known that a lamp wherein the amount of sodium and mercury employed is only that which will become totally vaporized would provide the desired result. In other words, a high pressure sodium lamp of the unsaturated vapor type wherein sodium and mercury are introduced in only such an amount as to become totally vaporized is a highly desirable structure insofar as efficiency, cost of manufacture and enhanced lighting capability are concerned.

However, one of the major problems encountered in the fabrication of unsaturated vapor high pressure sodium lamps is the introduction therein of the proper amounts of sodium and mercury. Since the sodium content is of a relatively small amount and sodium is such a chemically active material, it has been found most difficult to dose or introduce the proper amount thereof into the arc tube of an unsaturated vapor high pressure sodium lamp.

One known suggestion for dosing an arc tube for a high pressure sodium lamp with the prop of sodium and mercury is set forth in U.S. Pat. No. 4,156,550, issued to Furukubo et al on May 29, 1979. Therein, sodium azide (NaN3) was dissolved in a solvent, placed in a container and the solvent evaporated. Also, a mercury dispenser in the form of an Al-Zr-Ti-Hg alloy was placed in the container. Thereafter, the container was positioned within one exhaust pipe affixed to the arc tube, and this one exhaust pipe was closed or pinched off. Another exhaust pipe or tube was affixed to the other end of the arc tube and to an exhaust system. The exhaust tube having the container therein was heated to decompose the sodium and mercury-containing compounds and provide the desired sodium and mercury within the arc tube. Also, the arc tube was evacuated and re-filled with a starting gas.

Although the above-described technique may or may not be employed in an unsaturated vapor high pressure sodium lamp fabrication process, it is submitted that the process leaves something to be desired. More specifically, the process appears to be relatively expensive of components, procedural steps and apparatus. For example, the suggested exhaust tubes of niobium are relatively expensive and not readily available in ordinary high pressure sodium lamp manufacturing facilities.

OBJECTS AND SUMMARY OF THE INVENTION

An object of the present invention is to provide an enhanced unsaturated vapor high pressure sodium lamp. Another object of the invention is to improve the dosing of an arc tube for an unsaturated vapor high pressure sodium lamp. Still another object of the invention is to provide an improved process for dosing the arc tube of an unsaturated vapor high pressure sodium lamp. A further object of the invention is to enhance the manufacture of unsaturated vapor high pressure sodium lamps.

These and other objects, advantages and capabilities are achieved in one aspect of the invention by a dosing process for arc tubes of unsaturated vapor high pressure sodium lamps wherein a sodium-containing compound, oxygen-absorbing getter, mercury and a rare gas are located within an arc tube, the arc tube is sealed, and the sodium compound decomposed within the arc tube to provide sodium with the oxygen generated by the process chemically combined with the oxygen getter to prevent reformation of the original sodium compound.

BEST MODE FOR CARRYING OUT THE INVENTION

For a better understanding of the present invention, together with other and further objects, advantages and capabilities thereof, reference is made to the following disclosure and appended claims in connection with the accompanying drawings.

Figure 1:
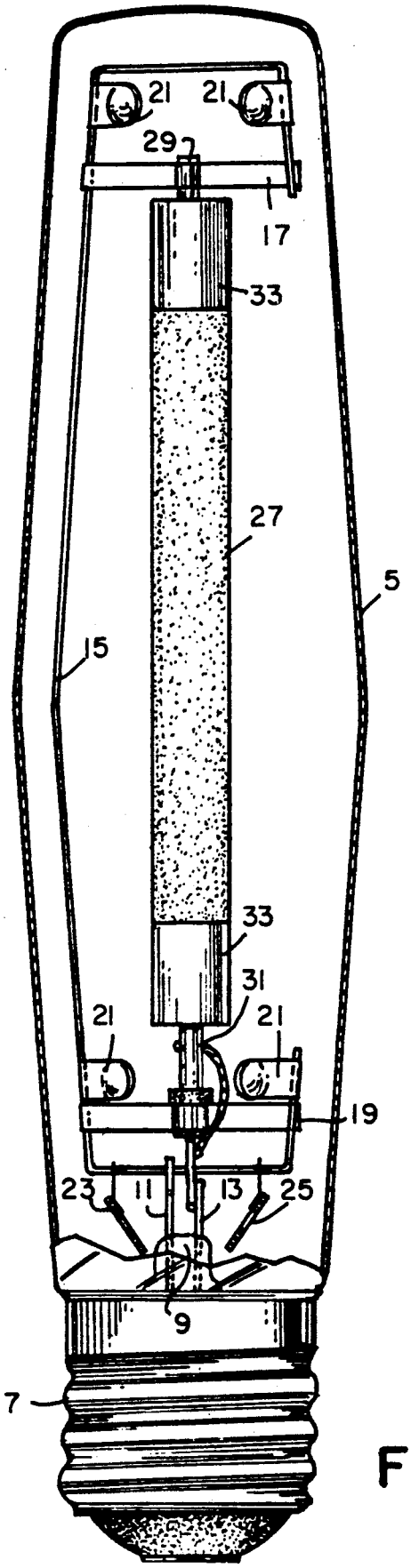
FIG. 1 is an elevational view of an unsaturated vapor high pressure sodium lamp fabricated in accordance with the process of the invention.

Referring to the drawings, FIG. 1 illustrates an unsaturated vapor high pressure sodium lamp having a hermetically sealed and evacuated glass envelope 5 formed to fit into an ordinary screw-type base member 7. A glass stem member 9 is sealed to the envelope 5 and projects therein. Electrical conductors, 11 and 13 respectively, are sealed into and pass through the stem member 9 to provide electrical connections from the interior to the exterior of the glass envelope 5.

An electrically conductive support member 15 is affixed to one of the electrical conductors 11 and has a pair of crossbars 17 and 19 affixed thereto at either end. Also, a plurality of spring-like members 21 are affixed to the support member 15 and formed for contact with the glass envelope 5. Moreover, a pair of getters 23 and 25 are attached to the support member 15 and serve to insure the integrity of the evacuated envelope 5.

Disposed within the glass envelope 5 and supported by the crossbars 17 and 19 is an arc tube 27. This arc tube 27, preferably of a material such as polycrystalline alumina for example, includes an electrode 29 and 31 at either end thereof. One electrode 29 is affixed to and supported by the crossbar 17 while the other electrode 31 is insulatingly supported by the other crossbar 19, but electrically connected to the electrical conductor 13 passing through the stem member 9. Heat conserving elements 33 may be wrapped about the arc tube 27 at each end thereof in the vicinity of the electrodes 29 and 31 in order to reduce the heat differential thereat from the center of the arc tube 27.

In the process of fabricating the above-described unsaturated vapor high pressure sodium lamp, it has been found to be most advantageous to dose the arc tube 27 in a manner whereby the sodium required for successful operation is effected by thermal decomposition within the arc tube 27 itself. More specifically, a sodium-containing compound, such as sodium aluminate having a decomposition temperature greater than about 600° C. is located within the arc tube 27. Preferably, the sodium-containing compound is positioned in the general vicinity of one of the electrodes 31. Also, an oxygen-absorbing getter of an alloy from the group of metals including aluminum, titanium, scandium, hafnium, cerium, zirconium, lanthanum, thorium, yttrium and other rare earth or actinide metals is positioned within the arc tube 27 in the vicinity of arc of the electrodes 31. Preferably, one end of the arc tube 27 is sealed and the sodium-containing compound and oxygen-absorbing getter are in pellet form and merely poured into the other end of the arc tube 27.

Thereafter, the arc tube 27 is flushed with an inert gas, such as nitrogen, and filled with a rare gas, such as xenon and mercury. Alternatively, the mercury may be included in a mercury-containing compound which is located within the arc tube 27 in the manner previously described with respect to the sodium-containing compound and oxygen-absorbing getter. In other words, decomposition of a mercury-containing compound within the arc tube 27 is also appropriate to the dosing of the arc tube 27.

Following, the sealing of the unsealed end of the arc tube 27 is effected, and the desired decomposition therein takes place during operational use. More specifically, the sodium-containing compound decomposes to provide oxygen and sodium and the oxygen-absorbing getter serves to absorb the oxygen to prevent reformation of the original sodium-containing compound. As a result, the desired dose of sodium, mercury and rare gas is provided within the arc tube 27.

Figure 2:
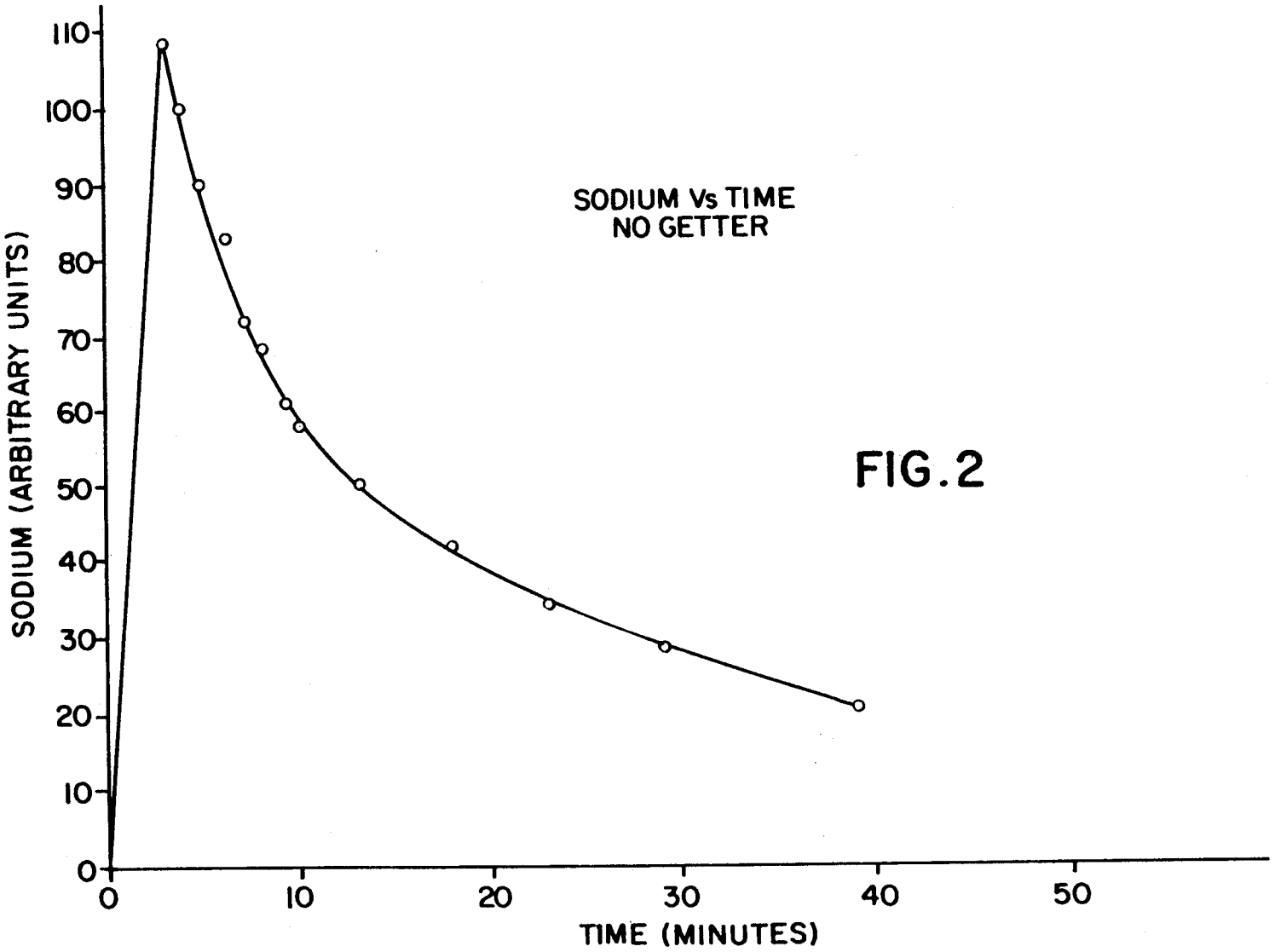
FIG. 2 is a graph illustrating the sodium content vs. time of an arc tube suitable to the lamp of FIG. 1 wherein the oxygen-absorbing getter is not present.
Figure 3:
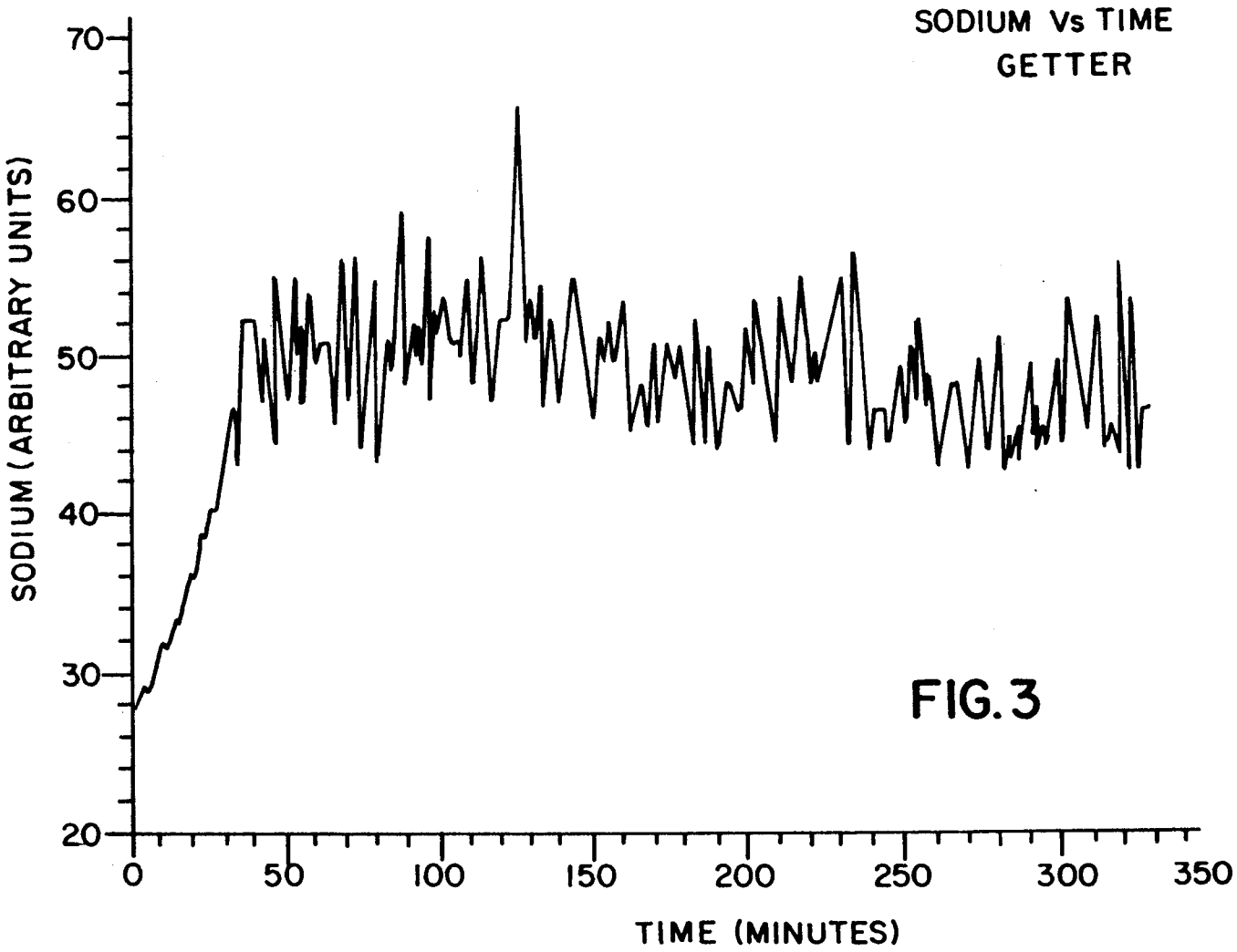
FIG. 3 is a graphic illustration of an arc tube for the lamp of FIG. 1 wherein a zirconium-aluminum alloy getter was employed.

Referring to FIGS. 2 and 3, a comparison is made between gettered and non-gettered unsaturated vapor high pressure sodium lamps. In FIG. 2, an arc tube is dosed with mercury, xenon and sodium aluminate located within the arc tube 27. However, the embodiment of FIG. 2 does not include an oxygen-absorbing getter within the arc tube 27. However, a zirconium-aluminum getter is included within the arc tube 27 of the embodiment of FIG. 3. As can readily be seen, sodium content of the embodiment of FIG. 2 without the oxygen-absorbing getter rapidly decreases with operational time. Contrarily, the zirconium-aluminum getter in the embodiment of FIG. 3 inhibits sodium-compound reformation whereupon the sodium content of the arc tube 27 remains substantially constant for an extended period of time.

Thus, an unsaturated vapor high pressure sodium lamp is provided by a process having numerous advantages over other known techniques. The process is inexpensive of process operations and component cost, but exhibits an efficiency of fabrication and dosing of an arc tube believed to be previously unattainable.

While there has been shown and described what is at present considered the preferred embodiments of the invention, it will be obvious to those skilled in the art that various modifications and changes may be made therein without departing from the invention as defined by the appended claims.

What is claimed is:

1. A process for dosing the arc tube of an unsaturated vapor high pressure sodium lamp comprising the steps of:

locating a fill consisting essentially of a sodium-and-oxygen-containing compound, an oxygen-absorbing getter, mercury and a rare gas within said arc tube; and sealing said arc tube whereby thermal decomposition of said sodium-and-oxygen-containing compound is effected within said arc tube to provide sodium and oxygen with said getter removing said oxygen to prevent sodium-and-oxygen-containing compound reformation.

2. The process of claim 1 wherein said sodium-and-oxygen-containing compound is in the form of sodium aluminate.

3. The process of claim 1 wherein oxygen-absorbing getter is an alloy of metals selected from the group consisting of aluminum, titanium, scandium, cerium, hafnium, lanthanum, yttrium, thorium an zirconium.

4. The process of claim 1 wherein said mercury is in the form of a mercury-containing compound which decomposes to provide mercury.

5. The process of claim 1 wherein said mercury is in the form of a liquid.

6. The process of claim 1 wherein said sodium-and-oxygen-containing compound is in the form of sodium aluminate and said oxygen-absorbing getter is in the form of a titanium metal alloy.

* * * * *